US012492056B2

(12) United States Patent
Hodrius et al.

(10) Patent No.: US 12,492,056 B2
(45) Date of Patent: Dec. 9, 2025

(54) PACKAGING AND STORAGE CASE WITH PAPER POSTS FOR SECURING ACCESSORIES SUCH AS ELECTRONIC ADAPTERS

(71) Applicant: Apple Inc., Cupertino, CA (US)

(72) Inventors: Manuel Hodrius, Stuttgart (DE); Kevin T Pagano, San Francisco, CA (US); Yixuan Hou, San Jose, CA (US); Yanbo Du, Dongguan (CN)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 18/646,643

(22) Filed: Apr. 25, 2024

(65) Prior Publication Data

US 2025/0333227 A1 Oct. 30, 2025

(51) Int. Cl.
*B65D 73/00* (2006.01)
*B65D 85/68* (2006.01)

(52) U.S. Cl.
CPC ..... *B65D 73/0014* (2013.01); *B65D 73/0078* (2013.01); *B65D 85/68* (2013.01); *B65D 2585/86* (2013.01)

(58) Field of Classification Search
CPC ..... B65D 73/00; B65D 73/0014; B65D 73/0021; B65D 73/0078; B65D 85/68; B65D 2585/86
USPC ..... 206/477, 478, 481, 482, 493, 718, 722; 211/70.6
See application file for complete search history.

(56) References Cited

U.S. PATENT DOCUMENTS 3,360,258 A * 12/1967 Nix ..... B65D 83/08 206/493
3,815,735 A * 6/1974 Cucuo ..... B65D 5/46 206/315.9
3,931,889 A * 1/1976 Roccaforte ..... G11B 23/0233 229/152
3,990,574 A * 11/1976 Roccaforte ..... B65D 5/5023 206/397
4,191,289 A * 3/1980 Austin ..... B65D 5/5026 206/780
4,421,230 A * 12/1983 Stanton ..... B65D 73/0007 206/820
5,375,717 A * 12/1994 Roshdy ..... B65D 81/056 206/464

(Continued)

FOREIGN PATENT DOCUMENTS

CN 202944723 U 5/2013
CN 211108698 U 7/2020

(Continued)

*Primary Examiner* — Bryon P Gehman
(74) *Attorney, Agent, or Firm* — Sterne, Kessler, Goldstein & Fox P.L.L.C.

(57) ABSTRACT

Packaging with paper posts for securing accessories such as electronic adapters to packaging. Such packaging includes a base panel and a paper post. The paper extends from the base panel and includes two side walls and a top panel. The side walls couple to and extend away from the base panel. The top panel extends between and is joined to the two side walls along fold lines. The top panel is spaced away from the base panel by the side walls. The two side walls taper toward each other in a direction parallel to the base panel and in a direction perpendicular toward the base panel.

21 Claims, 10 Drawing Sheets

(56) References Cited

U.S. PATENT DOCUMENTS

| | | | | |
|---|---|---|---|---|
| 5,598,924 | A * | 2/1997 | McCann | B25H 3/06 206/372 |
| 6,299,059 | B1 | 10/2001 | Bernstein | |
| 6,976,587 | B2 | 12/2005 | Liverman et al. | |
| 8,752,707 | B2 | 6/2014 | McDonald et al. | |
| 2010/0065460 | A1* | 3/2010 | Appelbaum | B65D 73/0014 206/467 |
| 2021/0053728 | A1 | 2/2021 | Wang et al. | |

FOREIGN PATENT DOCUMENTS

| | | |
|---|---|---|
| CN | 212922331 U | 4/2021 |
| CN | 113071129 B | 5/2023 |

* cited by examiner

PACKAGING AND STORAGE CASE WITH PAPER POSTS FOR SECURING ACCESSORIES SUCH AS ELECTRONIC ADAPTERS

FIELD

The described embodiments relate generally to retail packaging. More particularly, the present embodiments relate to folded panel packaging with paper posts for securing products to the packaging.

BACKGROUND

Product packaging is an integral part of a customer's experience. It introduces the customer to their product, and can affect the customer's feelings toward the product and the company that created it. Packaging that is simple, clean, and secure may help influence the customer's impression of the product packaged within. At the same time, intuitive securing elements strike a balance between securing the package in a closed state prior to purchase, for example, with the ease with which a customer may access their product within the packaging once a sale is complete.

Structural and environmental considerations may also play a role in designing packaging. For example, packaging may be designed to be environmentally friendly-while retaining sufficient structure to ensure robust protection for the products contained within it or for repeating use of the product. Where posts are used to secure products to and within the packaging, plastics are often used to provide robust protection and durability for repeated use. Packaging described in this document achieves these and other beneficial characteristics by balancing structural robustness, eco-friendly materials, secure attachment features with intuitive user experiences, and aesthetic elements.

SUMMARY

In some embodiments, packaging includes a base panel and a paper post. The paper post is configured for mounting a product thereon. The paper post extends from the base panel and includes two side walls and a top panel. The side walls couple to and extend away from the base panel. The top panel extends between and joins to the side walls along fold lines. The top panel is spaced away from the base panel by the side walls. The side walls taper toward each other in a direction parallel to the base panel and in a direction perpendicular toward the base panel.

In some embodiments, the two side walls each form an undercut between the base panel and the top panel.

In some embodiments, the two side walls are spaced closer to each other at their connection to the base panel than at their connection to the top panel.

In some embodiments, the paper post extends through an aperture formed in a cover.

In some embodiments, an area of the top panel is larger than an area of the aperture of the cover.

In some embodiments, the base panel extends beneath the cover.

In some embodiments, the base panel is fixed to the cover.

In some embodiments, the two side walls and the top panel form a channel therebetween extending between first and second ends of the paper post.

In some embodiments, the two side walls and the top panel deform when the product is mounted on the paper post.

In some embodiments, the base panel, the two side walls, and the top panel are formed from a single piece of material, and wherein the two side walls are joined to the base panel along fold lines.

In some embodiments, the paper post forms an interference fit with a t-slot of the product when the product is mounted on the paper post.

In some embodiments, packaging is configured for repeatedly securing a plurality of products. Such packaging includes a cover layer and a plurality of paper posts. The cover layer includes a plurality of apertures formed through the cover. The plurality of paper posts extends through the plurality of apertures and above the cover layer. Each post is configured to secure an individual product to the cover layer. Each post of the plurality of posts includes a first end having a first width, and a second end having a second width greater than the first width.

In some embodiments, the cover includes a first edge. The first end of a first post of the plurality of posts is spaced apart from the first edge by a first distance. The first end of a second post of the plurality of posts is spaced apart from the first edge by the first distance. The first end of a third post of the plurality of posts is spaced apart from the first edge by a second distance different from the first distance.

In some embodiments, the plurality of posts further includes a plurality of connecting portions extending between adjacent posts of the plurality of posts and disposed below the cover layer.

In some embodiments, the plurality of posts and the plurality of connecting portions are formed of a unitary folded paper sheet.

In some embodiments, the plurality of connecting portions are fixed to the cover layer.

In some embodiments, packaging is configured for securing and supporting a plurality of products within the packaging. Such packaging includes a base layer, a support structure, and an attachment layer. The support structure is fixed to the base layer and configured to support the plurality of products when the packaging is in a closed configuration. The attachment layer is fixed to the base layer. The attachment layer includes a plurality of paper posts configured to secure the plurality of products to the packaging.

In some embodiments, the base layer includes a first area and a second area foldably attached to the first area along a fold line. The support structure is fixed to the first area and the attachment layer is fixed to the second area such that the attachment layer can rotate relative to the support structure between the closed configuration and an open configuration.

In some embodiments, the support structure includes a support surface and a side surface extending between the support surface and the base layer, and the support surface contacts and supports a body of a first product of the plurality of products in the closed configuration.

In some embodiments, a recess is formed in the support surface and the side surface, and wherein the recess includes a recess support surface configured to support and contact a body of a second product of the plurality of products in the closed configuration.

In some embodiments, the attachment layer can be rotated relative to the support structure between an open configuration and the closed configuration. The packaging can be repeatedly moved between the open configuration and the closed configuration without damaging any of the base layer, the support structure, or the attachment layer.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
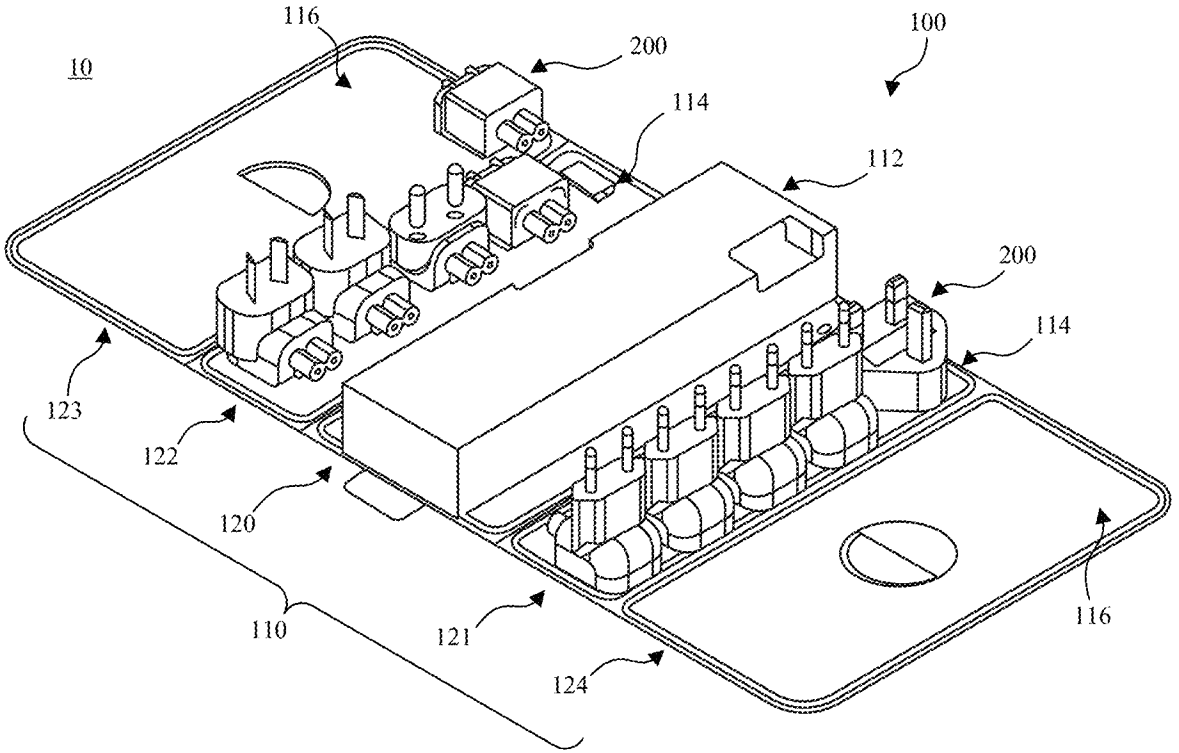
FIG. 1 shows an opened perspective view of packaging for a plurality of products.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The following disclosure relates to packaging for attaching products to one or more paper posts. The packaging may be retail packaging (i.e., finished packaging for containing and conveying a product to a user such as may be used in a retail setting, not shipping packaging providing outer packaging for containing a packaged product during shipment) that one may expect to find on the shelf in a retail store, and which one may open after purchase to directly access their product. The packaging also may be intended for repeated use after the point of sale. Accordingly, the packaging may be durable such that the packaging can be reused by the user for storing the products, and/or traveling with the products. The packaging may be repeatedly opened and closed without damaging, and products may be repeatedly attached and detached to the paper posts without damaging.

The packaging may be made out of recyclable and/or biodegradable materials, such as paper, cardboard, greyboard, cardboard or other cellulose-based products that can reduce environmental impact, especially when it is intuitive for a customer to properly recycle the packaging and it may be recycled in a single-stream system.

The packaging may be assembled from individual components that are made from paper sheets. Accordingly, at least some of the individual components may fold to form three-dimensional structures and features within the packaging. In addition, the layered paper sheets may provide uniform aesthetics across surfaces of the packaging. In some embodiments, outwardly facing surfaces of the packaging may be covered in a wrap of panels of a finished cellulose-based product (e.g., paperboard such as solid bleached sulfate "SBS"), while some of structure of the packaging may be provided by a different material, such as greyboard or cardboard or a fill-in material for added thickness, strength, or rigidity.

Various products may be stored within the packaging. In the illustrative embodiments, the product contained by the packaging are accessories: electronic power adapters for use in different countries. The products may have common coupling features but otherwise have different shapes and sizes. Accordingly, the paper posts of the packaging may align to accommodate an arrangement of products of different shapes and sizes that maximizes use of the space within the packaging and reduces a footprint of the packaging. The re-usability of the packaging as a case for storing the accessories may be beneficial to a user who travels with it, so that it can compactly contain the several accessories (e.g., power adapters) that the user may need throughout their travels.

These and other embodiments are discussed below with reference to the accompanying figures. However, those skilled in the art will readily appreciate that the detailed description given herein with respect to these figures is for explanatory purposes only and should not be construed as limiting.

Figure 2:
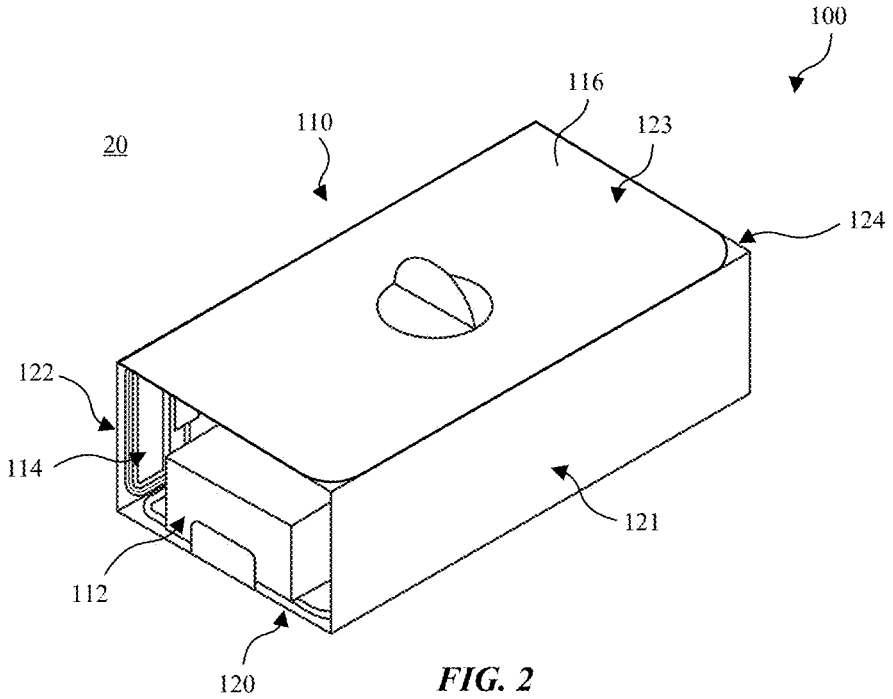
FIG. 2 shows a closed perspective view of the packaging of FIG. 1.

FIGS. 1 and 2 show a packaging 100 for securing and supporting products 200 to and within packaging 100. As shown, packaging 100 may be foldable and/or moved between an opened configuration 10 (e.g. FIG. 1), and a closed configuration 20 (e.g. FIG. 2). Each product 200 may be detachably secured to a paper post 152, 154, 156 of packaging 100. When packaging 100 is in the opened configuration 10, the products 200 may be attached to or detached from the paper posts 150. When packaging 100 is in the closed configuration 20, the products 200 may be secured within and prevented from detaching from packaging 100. In some embodiments, packaging 100 may be repeatedly moved between the opened and closed configurations 10, 20 without damaging packaging 100. In some embodiments, the products 200 may be repeatedly detached from and attached to the paper posts 150 without damaging the paper posts 150.

Packaging 100 may be assembled from a plurality of unitary paper sheets. For example, the illustrative packaging shown in FIGS. 1, 2, and 8, may be assembled from less than ten unitary paper sheets. In some embodiments, multiple paper posts 150 may be integrally formed from a unitary folded paper sheet. The paper sheet may be folded to form a three-dimensional structure so as to form individual posts 152, 154, 156 that extend away from a base panel 158 and are configured to attach with the products 200 to secure the products 200 to packaging 100.

Each product 210, 212, 214 of the plurality of products 200 may include a body 202 and a T-slot 204 formed in body 202. In some embodiments, T-slot 204 may be sized to extend over a first end 166 of a post 152 of the plurality of paper posts 150. T-slot 204 may have a T-slot width 206 that is less than a second width 174 of a second end 168 of post 152 such that product 210 cannot extend beyond second end 168 of post 152. Accordingly, T-slot 204 forms an interference fit or friction fit with post 152 along the length of post 152 between first end 166 and second end 168. The interference fit between product 210 and post 152 securely attaches product 210 to packaging 100.

Packaging 100 may include a base layer 110, a support structure 112, attachment layers 114, and lid panels 116, as shown, for example in FIGS. 1, 2, and 8-11. Each of support structure 112, attachment layers 114, and lid panels 116 may be fixed to at least one of areas 120, 121, 122, 123, 124 of an interior surface of base layer 110. In the illustrative embodiment shown in FIG. 1, packaging 100 may include a single support structure 112 centrally fixed to base layer 110, two attachment layers 114 fixed to base layer 110 on opposite sides of support structure 112, and two lid panels 116 fixed to base layer 110 on distal sides of attachment layers 114. In some embodiments, support structure 112, attachment layers 114, and lid panels 116 may be fixed to base layer 110 by adhesives, high-frequency welding, or other suitable coupling techniques. In some embodiments, high-frequency welding of adjacent layers improves recyclability of the assembly.

Base layer 110 may be formed from a unitary folded paper sheet and form a smooth exterior surface of packaging 100 when packaging 100 is in the closed configuration 20. In the open configuration 10, base layer 110 may be folded flat, as shown, for example, in FIGS. 1 and 8. In some embodiments, base layer 110 may include fold lines 126 (e.g., fold lines 126 parallel to each other) between adjacent areas 120, 121, 122, 123, 124 such that base layer 110 may fold about fold lines 126 into a box shape in the closed configuration 20, as shown, for example, in FIGS. 2 and 11.

In the illustrative embodiment shown in FIG. 1, support structure 112 is fixed to first area 120, attachment layers 114 are fixed to second area 121 and third area 122 respectively, and lid panels 116 are fixed to fourth area 123 and fifth area 124 respectively. As shown, for example, in FIGS. 2 and 11, attachment layers 114 may rotate about fold lines 126 relative to support structure 112 such that attachment layers 114 are approximately perpendicular to support structure 112 in the closed configuration 20. Lid panels 116 may rotate about fold lines 126 relative to attachment layers 114 such that lid panels 116 are approximately perpendicular to attachment layers 114, and lid panels 116 overlap one another in the closed configuration 20.

Each attachment layer 114 may include a cover layer 140 and paper posts 150 as shown, for example, in FIGS. 3-7. Attachment layer 114 may be configured to secure products 200 to packaging 100. Each product 210, 212, 214 of the plurality of products 200 may include a body 202 and a T-slot 204 formed in body 202. Each post 152, 154, 156 of the plurality of paper posts 150 may include two sidewalls that form an undercut relative to cover layer 140 such that T-slot 204 may be arranged over one of posts 152, 154, 156 and secure therewith.

Paper posts 150 may include a base panel 158 and a plurality of posts 152, 154, 156 as shown, for example, in FIGS. 3-7. Posts 150 may be formed from a unitary folded paper sheet such that each post 152, 154, 156 may be formed by folding the unitary paper sheet along fold lines 164, 165 to form a three-dimensional structure that extends away from base panel 158. In some embodiments, fold lines 164, 165 are non-parallel to one another such that posts taper in a direction parallel to base panel 158 and a direction perpendicular to base panel 158.

Base panel 158 may extend between adjacent posts 152, 154, 156 to form a connecting portion between the posts 152, 154, 156. In some embodiments, base panel 158 may be disposed below cover layer 140. In some embodiments, posts 152, 154, 156 may extend away from the base panel 158 and above cover layer 140. In some embodiments, each post 152, 154, 156 may extend through an aperture of a plurality of apertures 142 formed in cover layer 140. In some embodiments, base panel 158 may be fixed to cover layer 140 on one side and to base layer 110 on the opposite side. In some embodiments, a portion of cover layer 140 not fixed with base panel 158 may be fixed to base layer 110. In some embodiments, base panel 158 may be fixed to cover layer 140 and/or base layer 110, and cover layer 140 may be fixed to base layer 110 by adhesives, high-frequency welding, or other suitable coupling techniques.

In some embodiments each post 152, 154, 156 is configured to secure an individual product 210, 212, 214 of the plurality of products 200 as shown, for example, in FIGS. 1, 3, 5B, and 9-11. Each post 152, 154, 156 may be substantially similar to a first post 152. First post 152 may include a first sidewall 160, a second sidewall 161, a top panel 162, a first end 166, and a second end 168 as shown, for example, in FIGS. 3-5B. Sidewalls 160, 161 may be joined with base panel 158 at base fold lines 164. Top panel 162 may be joined to sidewalls 160, 161 at top fold lines 165 and extend between sidewalls 160, 161. Top panel 162 may be spaced apart from base panel 158. Top panel 162 may have a first width 172 at first end 172 and a second width 174 and second end 168 different from the first width 172 such that top panel 162 tapers between first end 166 and second end 168 in a direction parallel to base panel 158. Sidewalls 160, 161 may form an undercut between base panel 158 and top panel 162 such that sidewalls 160, 161 taper towards each other in a direction perpendicular to base panel 158. Sidewalls 160, 161, at base fold lines 164, may be spaced apart by third width 173 at first end 166 and fourth width 175 at second end 168.

In some embodiments, second width 174 is greater than first width 172. In some embodiments, second width 174 may be between about 10 mm and about 13 mm. In some embodiments, second width 174 may be between about 11 mm and about 12 mm. In some embodiments, first width 172 may be between about 8 mm and about 11 mm. In some embodiments, first width 172 may be between about 9 mm and about 10 mm. In some embodiments, fourth width 175 is greater than third width 173. In some embodiments, fourth width 175 may be between about 6 mm and about 9 mm. In some embodiments, fourth width 175 may be between about 7 mm and about 8 mm. In some embodiments, third width 173 may be between about 4 mm and about 7 mm. In some embodiments, third width 173 may be between about 5 mm and about 6 mm.

In some embodiments, second width 174 may be between about 105% and about 130% of first width 172. In some embodiments, second width 174 may be between about 110% and about 125% of first width 172. In some embodiments, fourth width 175 may be between about 105% and about 130% of third width 173. In some embodiments, fourth width 175 may be between about 110% and about 125% of third width 173.

Figure 3:
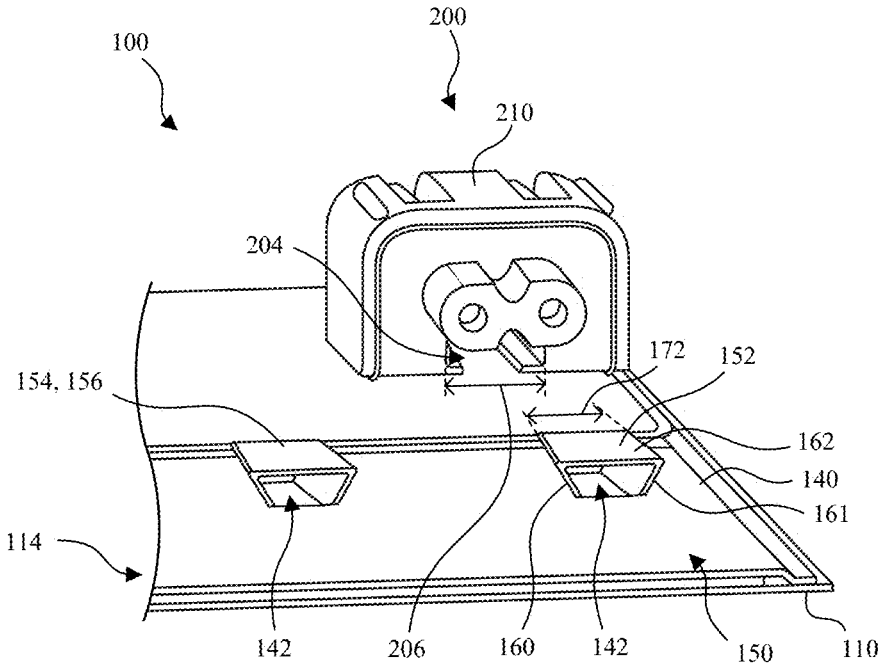
FIG. 3 shows a cutaway perspective view of a portion of the packaging shown in FIG. 1 showing two paper posts.
Figure 4:
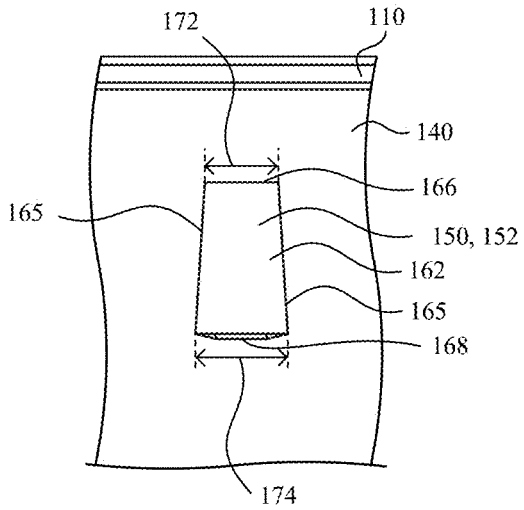
FIG. 4 shows a top view of a portion of the packaging shown in FIG. 1 showing a single paper post.
Figure 5A:
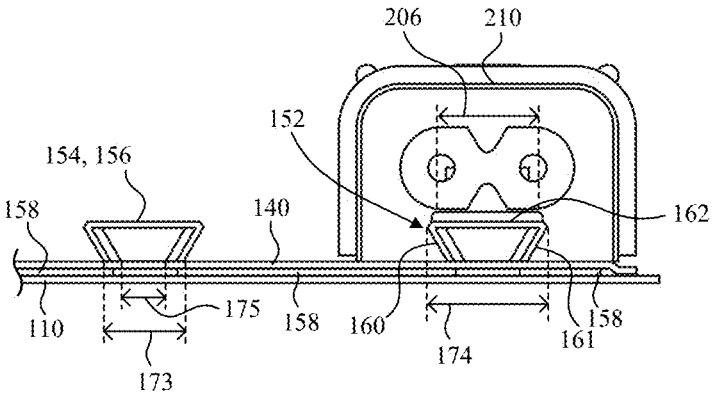
FIGS. 5A and 5B show front views of a portion of the packaging shown in FIG. 1 showing a paper post disassembled and assembled with a product.
Figure 5B:
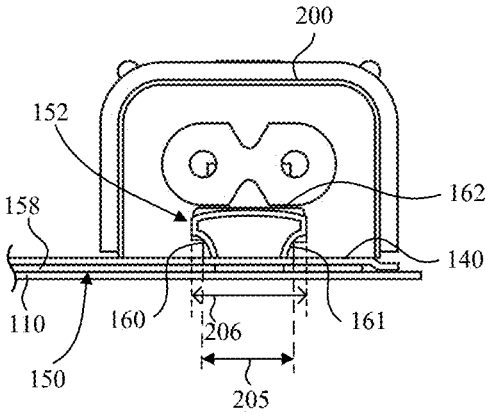
Figure 6:
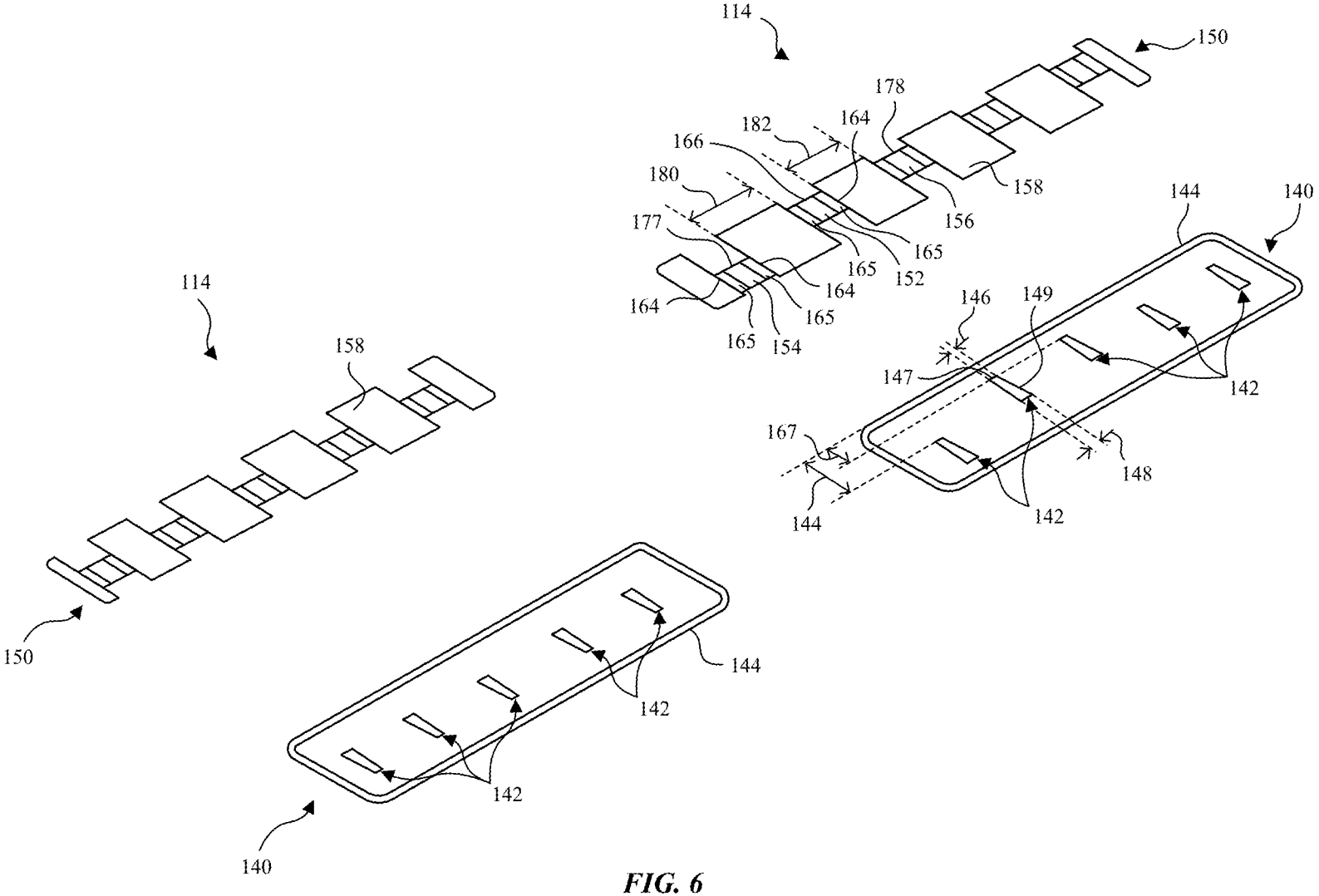
FIG. 6 shows an exploded view of an attachment layer of the packaging of FIG. 1.
Figure 7:
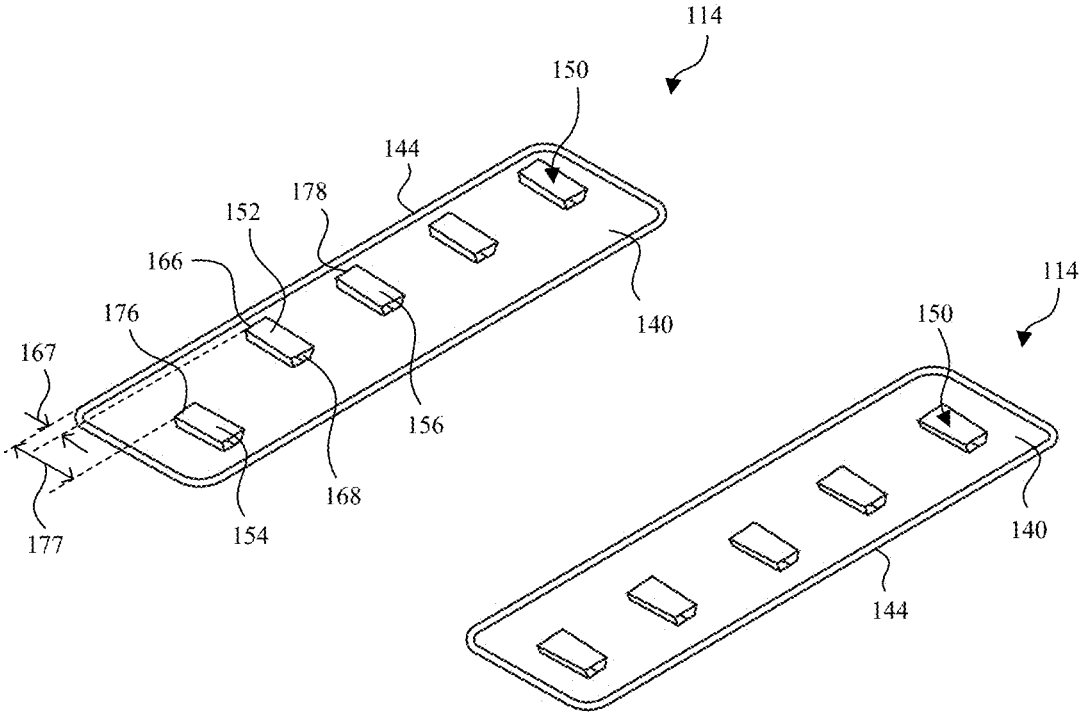
FIG. 7 shows an assembled view of the attachment layer of FIG. 6.

In some embodiments, T-slot 204 of one of products 210, 212, 214 may have a slot width 206 greater than first width 172 of first post 152 such that one of products 210, 212, 214 may slide over first end 166 of first post 152 a shown, for example, in FIG. 3. In some embodiments, slot width 206 may be less than second width 174 such that an interference fit or friction fit is formed with t-slot 204 along the length of first post 152, between first end 166 and second end 168. In some embodiments, T-slot 204 of one of products 210, 212, 214 may have a slot channel 205 greater than third width 173 of first post 152 such that one of products 210, 212, 214 may slide over first end 166 of first post 152 a shown, for example, in FIG. 3. In some embodiments, slot channel 205 may be less than fourth width 175 such that an interference fit or friction fit is formed with t-slot 204 along the length of first post 152, between first end 166 and second end 168. In some embodiments, product 210, 212, 214 may not slide beyond second end 168 of first post 152. In some embodiments, sidewalls 160, 161 and top panel 162 form a deformable channel 170 therebetween.

In some embodiments, when product 210, 212, 214 is arranged and slid along first post 152, the interference fit between t-slot 204 and first post 152 begins where the width of post 152 on top panel 162 is equal to t-slot width 206 and/or where the width of post 152 adjacent to base panel 158 is equal to t-slot channel 205. As product 210, 212, 214 continues to slide towards second end 168 of post 152, the interference increases with t-slot 204 such that sidewalls 160, 161 and/or top panel 162 deform towards the interior walls of t-slot 204 as shown, for example, in FIG. 5B. In some embodiments, sidewalls 160, 161 and/or top panel 162 may eventually deform to have a similar shape to t-slot 204 at the location of the interference fit with t-slot 204. In some embodiments, sidewalls 160, 161 and/or top panel 162 deform into channel 170. In some embodiments, deformation of first post 152 is temporary, and when product 210, 212, 214 is removed from first post 152, first post 152 returns to its original shape as shown, for example, in FIG. 5A.

As described above, each post 152, 154, 156 of the plurality of paper posts 150 extends through a corresponding aperture of the plurality of apertures 142 in cover layer 140. Each aperture of the plurality of apertures 142 includes a first aperture width 146 at a first end 147, and a second aperture width 148 and a second end 149. First and second ends 147, 149 of each aperture of the plurality of apertures 142 correspond to first and second ends 166, 168 of each post of the plurality of paper posts 150. In some embodiments, first and second aperture widths 146, 148 may be different such that each aperture of the plurality of apertures 142 tapers between first end 147 and second end 149.

In some embodiments, first aperture width 146 may be less than first width 172 of first post 152 such that top panel 162 extends over cover layer 140 adjacent to first end 147 of the aperture of the plurality of apertures 142. In some embodiments, second aperture width 148 may be less than second width 174 of first post 152 such that top panel 162 extends over cover layer 140 adjacent to second end 149 of the aperture of the plurality of apertures 142. In some embodiments, first aperture width 146 may be less than third width 173 of first post 152 and second aperture width 148 may be less than fourth width 175 of first post 152 such that there is a small interference fit between the first post 152 at base fold lines 164 and the aperture of the plurality of apertures 142. In some embodiments, first aperture width 146 may be equal to third width 173 of first post 152 and second aperture width 148 may be equal to fourth width 175 of first post 152.

In some embodiments, first aperture width 146 may be between about 3 mm and about 7 mm. In some embodiments, first aperture width 146 may be between about 4 mm and about 6 mm. In some embodiments, first aperture width 146 may be about 5 mm. In some embodiments, second aperture width 148 may be between about 5 mm and about 9 mm. In some embodiments, second aperture width 148 may be between about 6 mm and about 8 mm. In some embodiments, second aperture width 148 may be about 7 mm. In some embodiments, second aperture width 148 may be between about 110% and about 150% of first aperture width 146. In some embodiments, second aperture width 148 may be between about 120% and about 135% of first aperture width 146. In some embodiments, each aperture of the plurality of apertures 142 has an aperture area less than a top panel area of top panel 162.

In some embodiments, products 200 vary in shape and size such that the posts 152, 154, 156 and corresponding apertures 142 are positioned along attachment layer 114 to accommodate the varying shapes and sizes of each product 210, 212, 214. In some embodiments, cover layer 140 includes first edge 144, and posts 152, 154, 156 are positioned at different distances from first edge 144. For example, first end 166 of first post 152 is positioned a first distance 167 from first edge 144, and first end 176 of second post 154 is positioned a second distance 177 from first edge 144 different from first distance 167. In a further example, first end 178 of third post 156 is positioned the first distance 167 from first edge 144 such that the first and third posts 152, 156 are aligned along their respective first ends 166, 178.

In some embodiments, posts 152, 154, 156 and apertures 142 are spaced equally along the length of attachment layer 114 such that connecting portions of base panel 158 between adjacent posts 152, 154, 156 have equal length. In some embodiments, posts 152, 154, 156 and apertures 142 are spaced unequally along the length of attachment layer 114 to accommodate different widths of products 200. For example, a connecting portion of base panel 158 between first and second posts 152, 154 may have a first connecting length 180 and a connecting portion of base panel 158 between second and third posts 154, 156 may have a second connecting length 182 different from the first connecting length 180, as shown, for example, in FIG. 6.

In some embodiments, cover layer 140 may be a cosmetic cover piece configured to hide and conceal fold lines 164, 165 of paper posts 150. In some embodiments, cover layer 140 may include a fill-in material to add thickness to cover layer 140 for improved aesthetics and increased rigidity of attachment layer 114.

Figure 11:
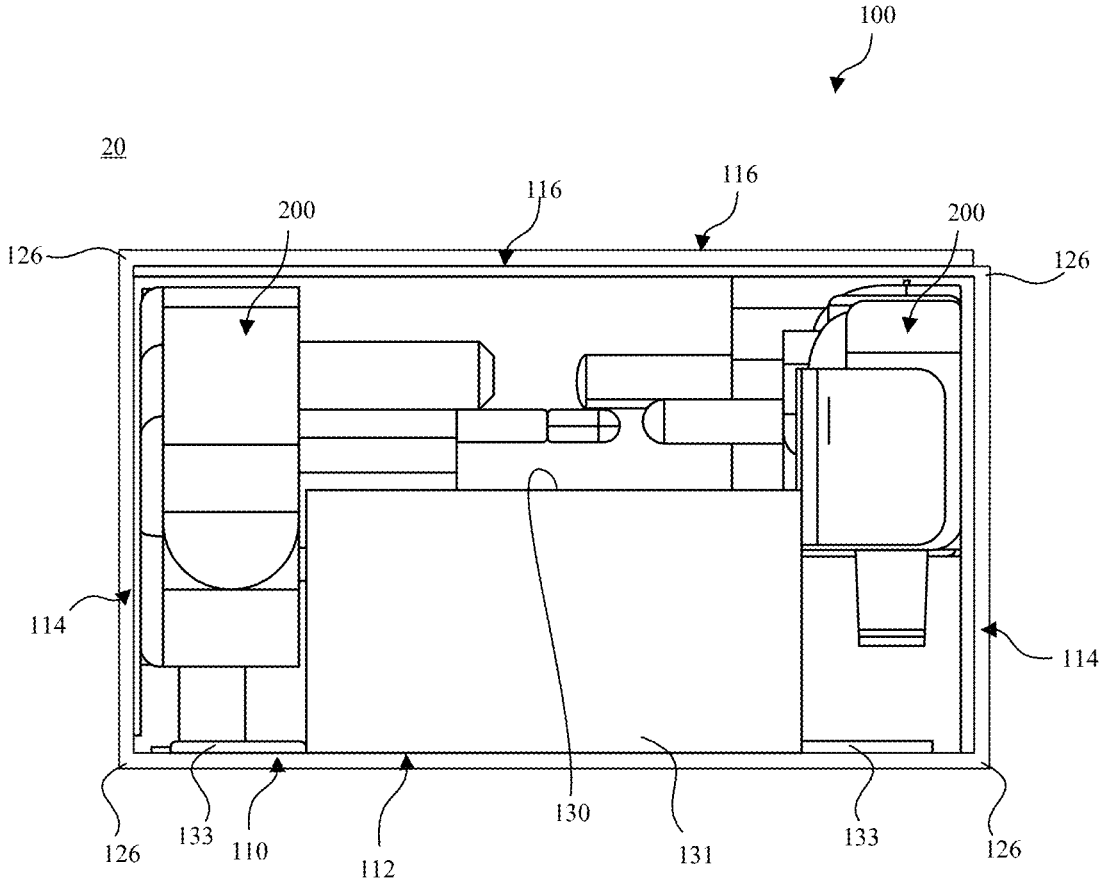
FIG. 11 shows a closed side view of the packaging of FIG. 1 with the plurality of products attached to the packaging and facing each other.

When packaging 100 is in the closed configuration 20, products 200 may be secured in a cantilever arrangement to posts 152, 154, 156 of attachment layers 114, as shown, for example, in FIG. 11. Support structure 112 is arranged perpendicular and adjacent to attachment layers 114 in the closed configuration 20 and configured to support products 200 in the cantilever arrangement. Support structure 112 may include support surface 130, end surfaces 131, side surfaces 132, and feet 133, as shown, for example, in FIGS. 1, 8, and 11. Support structure 112 may be formed from a unitary folded paper sheet. In the illustrative embodiment shown in FIG. 8, support structure 112 is folded along fold lines 135 to form a box shape that is fixed to base layer 110.

Feet 133 may be joined to side surfaces 132 along fold lines 135. In some embodiments, feet 133 are fixed to base layer 110 to attach support structure 112 to base layer 110. In some embodiments, feet 133 may be fixed to base layer 110 by adhesives, high-frequency welding, or other suitable coupling techniques. Feet 133 are dimensioned to space side surfaces 132 away from edges of first area 120 of base layer 110 to provide a channel between side surfaces 132 and attachment layers 114 in the closed configuration 20. In some embodiments, the channel may be configured to accommodate a portion of products 200 and limit movement of products 200 within packaging 100. In some embodiments, feet 133 may include a fill-in material to add thickness to feet 133 for improved aesthetics and aesthetic uniformity with cover layer 140.

Support surface 130 may be spaced apart from base layer 110 by side surfaces 132 as shown, for example, in FIG. 11. Support surface 130 may extend approximately parallel to first area 120 of base layer 110 and approximately perpendicular to side surfaces 132. Support surface 130 may extend between side surfaces 132 and may be joined to side surfaces 132 at fold lines 135. In the illustrative embodiment shown in FIG. 11, support surface 130 is configured to contact and support bodies 202 of products 200 when packaging 100 is in the closed configuration 20. In some embodiments, support surface 130 reduces a cantilever load on the paper posts 150. End surfaces 131 extend away from support surface 130 toward base layer 110. In some embodiments, end surfaces 131 extend approximately perpendicular to support surface 130 and side surfaces 132. In some embodiments, end surfaces 131 may include flaps to fix end surfaces 131 with base layer 110 and position end surfaces 131 relative to support surface 130 and side surfaces 132.

Figure 8:
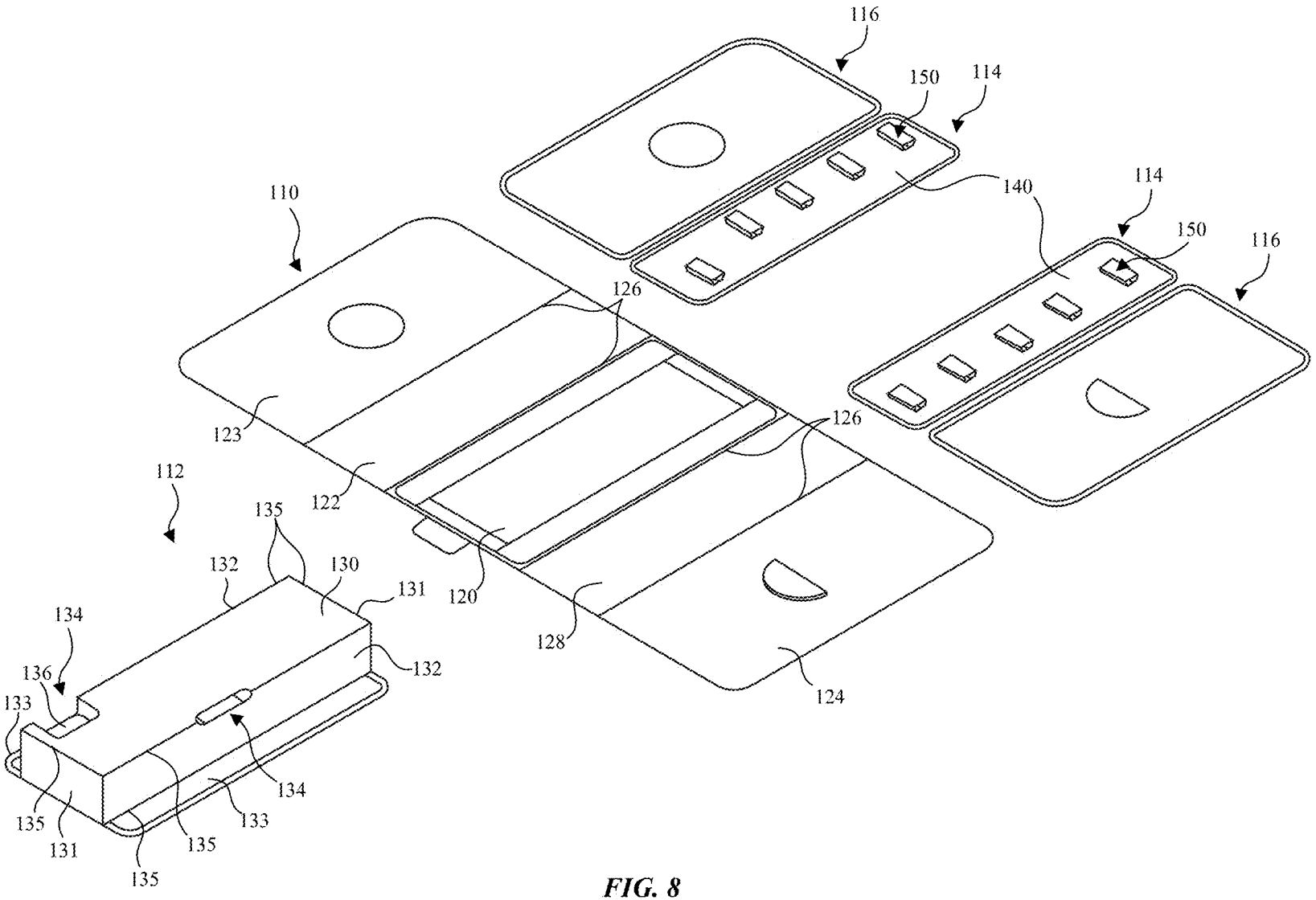
FIG. 8 shows an exploded view of the packaging of FIG. 1 having a base layer, a support structure, a pair of attachment layers, and a pair of lids.
Figure 9:
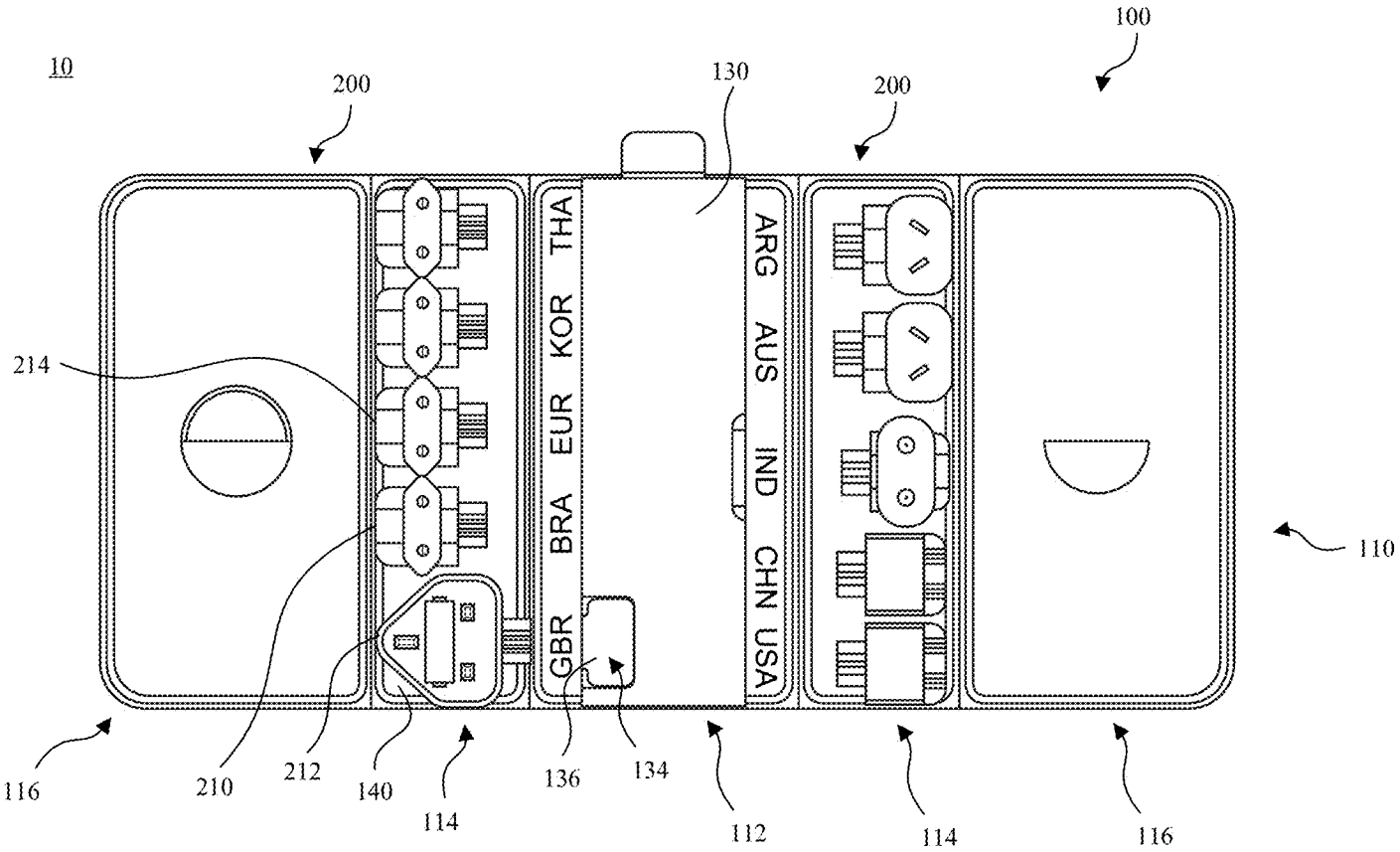
FIG. 9 shows an opened top view of the packaging of FIG. 1 with the plurality of products attached to the packaging.

In the illustrative embodiment shown in FIGS. 8 and 9, a recess 134 is formed in support surface 130 and one of side surfaces 132. Recess 134 is shaped and sized to accommodate a second product 212 that is larger than the channel formed between attachment layer 114 and side surface 132. Recess 134 may include a recess support surface 136. Recess support surface 136 may be parallel with and spaced apart from support surface 130. Recess support surface 136 may be configured to contact and support a body 202 of second product 212 that is not aligned with the other products of the plurality of products 200. In some embodiments, recess 134 may correspond and align with the positioning of posts 152, 154, 156 relative to first edge 144 of cover layer 140. For example, second product 212 may have a larger body 202 such that second post 154 is spaced apart from first edge 144 differently to an adjacent post 152, and recess is aligned to second post such that body 202 of second product 212 may contact and be supported by recess support surface 136.

Figure 10:
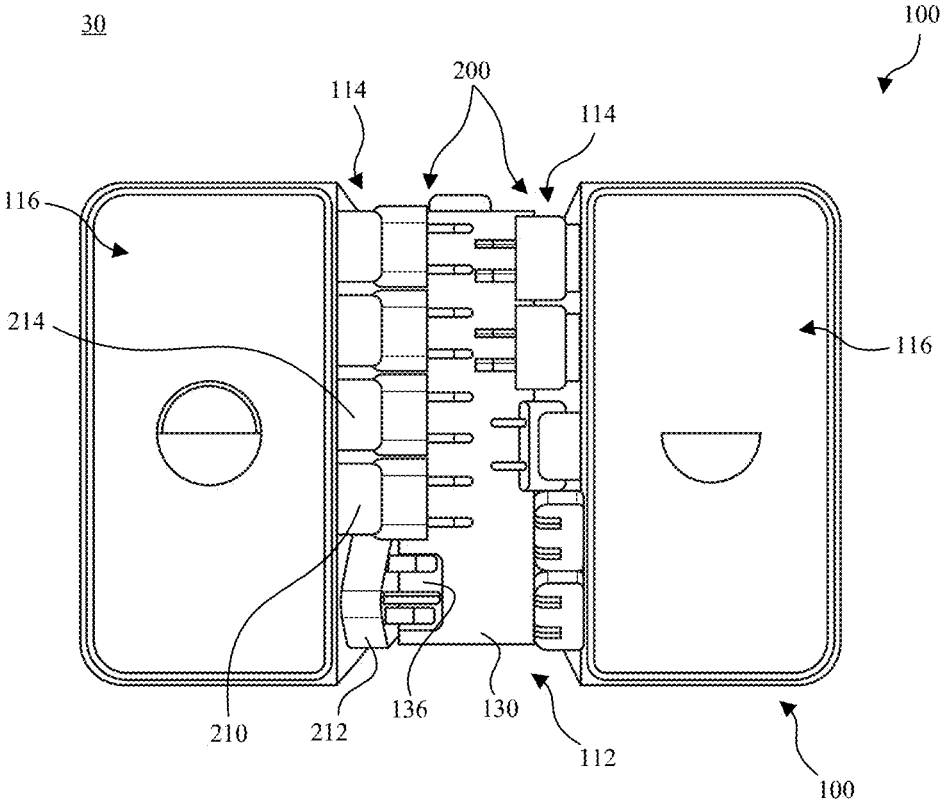
FIG. 10 shows a partially opened top view of the packaging of FIG. 1 with the plurality of products attached to the packaging and facing each other.

In some embodiments, products 200 may be outlet socket connectors for different countries with electrical prongs of varying shapes and sizes, as shown, for example, in FIGS. 9-10. In the closed configuration 20, the electrical prongs of each connector may extend away from opposing attachment layers 114 and toward each other. Accordingly, paper posts 150 may be arranged on attachment layer 114 such that products 200 are positioned so as not to interfere with each other in the closed configuration 20. In the illustrative embodiments shown in FIGS. 10 and 11, paper posts 150 are arranged such that each of the prongs of products 200 are positioned above, below, or to the side of one another in the closed configuration 20. Each post 152, 154, 156 can be positioned by varying the distance 167, 177 relative to first edge 144 of cover layer 140, and/or varying the connecting length 180, 182 between adjacent posts 152, 154, 156.

Lid panels 116 are fixed with fourth and fifth areas 123, 124 of base layer 110. In some embodiments, lid panels 116 may be fixed to base layer 110 by adhesives, high-frequency welding, or other suitable coupling techniques. Lid panels 116 may include a fill-in material to add thickness to fourth and fifth areas 123, 124 of base layer 110, improve aesthetics, and increase rigidity of base layer 110. In some embodiments, lid panels 116 may provide aesthetic uniformity with feet 133 and cover layer 140. In some embodiments, lid panels 116 and fourth and fifth areas 123, 124 rotate around fold lines 126 relative to attachment layers 114. In the illustrative embodiment shown in FIG. 10, lid panels 116 can rotate into a partially opened configuration 30 to uncover products 200 in the packaging 100 while maintaining attachment of products 200 with packaging 100. In the closed configuration 20, lid panels 116 fold on top of each other above support structure 112 to cover and close packaging 100. In some embodiments, lid panels 116 may include an interlocking feature to releasably to couple lid panels 116 together to maintain packaging 100 in the closed configuration 20.

In some embodiments, packaging 100 may hold products 200, such as power adapter wall plugs (sometimes known as duckheads), with posts 150 and channel system 170. Posts 150 and channels 170 may enable both friction fit and geometry fit to attach duck heads to packaging 100. Channel 170 may enable the duck heads to sit in packaging 100 securely, while being easy to remove. Packaging 100 may include a fold-open structure that encases all available duck heads. This collection may be a product to sell to world-travelers that make use of the interchangeability of power adapters. Packaging 100 envelops the duck heads into a case that can be used continuously to store and transport the duck heads, thus elevating packaging 100 from a pure shipping-vehicle to a lasting part of the product that has a use beyond the time of purchase.

In some embodiments, construction of packaging 100 may be fiber-based. In some embodiments, packaging 100 may be configured to be used beyond the initial transport, providing a case that can be used to store all duck heads when not needed. In some embodiments, channel 170 may have a trapezoidal shape. In some embodiments, the smaller end of channel 170 may be dimensioned towards a loose fit with an attachment feature of a duck head. In some embodiments, the larger end of channel 170 may feature a normal interference with the attachment feature of the duck head. This may enable a secure fitting of the duck heads with packaging 100. In some embodiments, construction of packaging 100 may utilize the ability of paper to be deformed easily. When the duck heads get assembled, the paper may deform. This may lead to a friction fit, and enable a secure, repeatable fitting of the parts.

Each of the components and their constituent parts, and other variations described herein may include corresponding features described with reference to each of the other components and features described without limitation.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. Packaging comprising:

a base panel; and a paper post for mounting a product thereon, the paper post extending from the base panel and comprising:

two side walls coupled to and extending away from the base panel; and a top panel extending between and joined to the two side walls along fold lines, the top panel spaced away from the base panel by the side walls, wherein the two side walls taper toward each other in a direction parallel to the base panel and in a direction perpendicular toward the base panel.

2. The packaging of claim 1, wherein the two side walls each form an undercut between the base panel and the top panel.

3. The packaging of claim 1, wherein the two side walls are spaced closer to each other at their connection to the base panel than at their connection to the top panel.

4. The packaging of claim 1, wherein the paper post extends through an aperture formed in a cover.

5. The packaging of claim 4, wherein an area of the top panel is larger than an area of the aperture of the cover.

6. The packaging of claim 4, wherein the base panel extends beneath the cover.

7. The packaging of claim 6, where the base panel is fixed to the cover.

8. The packaging of claim 1, wherein the two side walls and the top panel form a channel therebetween extending between first and second ends of the paper post.

9. The packaging of claim 8, wherein the two side walls and the top panel deform when the product is mounted on the paper post.

10. The packaging of claim 1, wherein the base panel, the two side walls, and the top panel are formed from a single piece of material, and wherein the two side walls are joined to the base panel along fold lines.

11. The packaging of claim 1, wherein the paper post forms an interference fit with a t-slot of the product when the product is mounted on the paper post.

12. Packaging for repeatedly securing a plurality of products, the packaging comprising:

a cover layer comprising a plurality of apertures formed through the cover layer; and a plurality of paper posts extending through the plurality of apertures and above the cover layer, wherein each post is configured to secure an individual product to the cover layer, wherein each post of the plurality of posts comprises a top panel extending parallel to and spaced apart from the cover layer, and wherein the top panel comprises a first end having a first width, and a second end having a second width greater than the first width.

13. The packaging of claim 12, wherein the cover layer comprises a first edge, wherein the first end of a first post of the plurality of posts is spaced apart from the first edge by a first distance, wherein the first end of a second post of the plurality of posts is spaced apart from the first edge by the first distance, and wherein the first end of a third post of the plurality of posts is spaced apart from the first edge by a second distance different from the first distance.

14. The packaging of claim 12, wherein the plurality of posts further comprises a plurality of connecting portions extending between adjacent posts of the plurality of posts and disposed below the cover layer.

15. The packaging for claim 14, wherein the plurality of posts and the plurality of connecting portions are formed of a unitary folded paper sheet.

16. The packaging of claim 14, wherein the plurality of connecting portions are fixed to the cover layer.

17. Packaging for securing and supporting a plurality of products within the packaging, the packaging comprising:

a base layer;

a support structure fixed to the base layer and configured to support the plurality of products when the packaging is in a closed configuration; and an attachment layer fixed to the base layer and configured to rotate relative to the support structure between an open configuration and the closed configuration, wherein the attachment layer comprises a plurality of paper posts configured to secure the plurality of products to the packaging in the open configuration and in the closed configuration.

18. The packaging of claim 17, wherein the base layer comprises a first area and a second area foldably attached to the first area along a fold line, wherein the support structure is fixed to the first area and the attachment layer is fixed to the second area such that the attachment layer can rotate relative to the support structure between the closed configuration and the open configuration.

19. The packaging of claim 17, wherein the support structure comprises a support surface and a side surface extending between the support surface and the base layer, and the support surface contacts and supports a body of a first product of the plurality of products in the closed configuration.

20. The packaging of claim 19, wherein a recess is formed in the support surface and the side surface, and wherein the recess comprises a recess support surface configured to support and contact a body of a second product of the plurality of products in the closed configuration.

21. The packaging of claim 17, wherein the packaging can be repeatedly moved between the open configuration and the closed configuration without damaging any of the base layer, the support structure, or the attachment layer.

* * * * *